US007395850B2

(12) United States Patent
Chino et al.

(10) Patent No.: US 7,395,850 B2
(45) Date of Patent: Jul. 8, 2008

(54) WINDING-UP SCREEN DEVICE

(75) Inventors: Mitsuhiko Chino, Tokyo (JP); Yoji Kamosawa, Tokyo (JP); Hirotsugu Toda, Tokyo (JP)

(73) Assignee: Seiki Hanbai Co., Ltd., Tokyo (JP)

( * ) Notice: Subject to any disclaimer, the term of this patent is extended or adjusted under 35 U.S.C. 154(b) by 194 days.

(21) Appl. No.: 10/557,844

(22) PCT Filed: May 10, 2004

(86) PCT No.: PCT/JP2004/006572

§ 371 (c)(1),
(2), (4) Date: Nov. 21, 2005

(87) PCT Pub. No.: WO2004/104357

PCT Pub. Date: Dec. 2, 2004

(65) Prior Publication Data

US 2007/0039698 A1 Feb. 22, 2007

(30) Foreign Application Priority Data

May 21, 2003 (JP) ..... 2003-143862

(51) Int. Cl.
*A47G 5/02* (2006.01)

(52) U.S. Cl. ..... 160/243; 160/29

(58) Field of Classification Search ..... 160/243, 160/244, 245, 272, 273.1, 84.06, 29, 30, 160/31, 98
See application file for complete search history.

(56) References Cited

U.S. PATENT DOCUMENTS

| | | | | |
|---|---|---|---|---|
| 4,821,786 | A * | 4/1989 | Johnston | 160/23.1 |
| 5,505,244 | A * | 4/1996 | Thumann | 160/23.1 |
| 6,059,007 | A * | 5/2000 | Tomita | 160/242 |
| 6,405,781 | B2 * | 6/2002 | Davies et al. | 160/23.1 |
| 6,463,983 | B1 * | 10/2002 | Lang | 160/23.1 |
| 6,478,070 | B2 * | 11/2002 | Poppema | 160/23.1 |
| 6,814,127 | B2 * | 11/2004 | Tagtow et al. | 160/31 |

FOREIGN PATENT DOCUMENTS

| | | |
|---|---|---|
| JP | 1-61158 | 12/1989 |
| JP | 2528590 | 12/1996 |
| JP | 2569974 | 2/1998 |
| JP | 2000-230381 | 8/2000 |
| JP | 2000-352280 | 12/2000 |
| JP | 2002-168072 | 6/2002 |

* cited by examiner

*Primary Examiner*—David Purol
(74) *Attorney, Agent, or Firm*—Oblon, Spivak, McClelland, Maier & Neustadt, P.C.

(57) ABSTRACT

A winding-up screen device in which, when a screen is wound around a winding axis, a screen guide for guiding the edge portion of the screen unwound from the winding axis is not left on the opening frame of a building. A joining groove is provided in the screen guide provided so as to go in and out between an opening frame and a fixed frame or a movable frame of the building, a joining part is attached to the edge portion, to be guided by the screen guide, of a screen, the screen guide goes in and out when the screen is wound and unwound by operation of the movable frame, and the joining part of the unwound screen is joined to the joining groove of the screen guide so as to freely slide.

15 Claims, 12 Drawing Sheets

WINDING-UP SCREEN DEVICE

TECHNICAL FIELD

The present invention relates to a winding-up screen device attached to an opening frame of a building for the purpose of dust resistance, glare protection, heat insulation, mothproof, and others.

BACKGROUND ART

Up to now, a winding-up screen device, in which a screen wound around a winding axis is supported between a fixed frame fixed in an opening frame of a building and a movable frame going to and coming back from the fixed frame and opening and closing operation can be performed in such a way that the screen is wound around the winding axis or unwound by the going and coming back movement of the movable frame, is well known.

Now, in such a winding-up screen device, since a gap is easily formed between both end portions of the screen unwound from a winding axis and an opening frame of a building, not only the outward appearance is poor, but also insects such as mosquitoes, flies, etc., easily enter the room through the gap particularly when the screen is an insect prevention net.

Then, in order to solve such a problem, in Japanese Examined Patent Application Publication No. 01-061158, a winding-up window screen device, in which one half of a tape as a slide fastener having many protrusion portions on one side thereof is attached to the edge portion of an insect prevention net, a rail having a groove is provided on an opening frame of a building, the one half of a tape as a slide fastener is passed through the groove of the rail so as to slide freely, and the protrusion portions are joined so as to slide freely, is proposed.

However, in such a winding-up window screen device disclosed in the above patent document, it is required to fix the rail having a groove for guiding the edge portion of an insect prevention net to the opening frame of a building and accordingly, even if the insect prevention net is wound around a winding axis to make the opening portion open, the rail having a groove is left on the opening frame and the external appearance is harmed. Moreover, when the above winding-up window screen device is used as a vertical opening type in which the opening and closing operation is performed upward and downward, the opening width is narrowed as much as the height of the rail, and, when it is used as a horizontal opening type in which the opening and closing operation is performed in the horizontal direction, the opening height is narrowed as much as the height of the rail and a difference in level because of the rail is formed on the floor where the lower frame of the opening frame is formed which may cause an obstacle when going in and out of a room through the opening frame is performed.

DISCLOSURE OF INVENTION

The present invention has been made to solve such a problem, and it is an object of the invention to provide a winding-up screen device in which, when a screen is wound around a winding axis to make the opening portion open, a screen guide for guiding the edge portion of the screen unwound from the winding axis is not left on the opening frame of a building.

In order to solve the above problem, a winding-up screen device according to the present invention comprises a fixed frame fixed to an opening frame of a building; a movable frame provided so as to be parallel to the fixed frame and movable to and from the fixed frame; a screen wound around a winding axis, the screen provided so as to extend between the fixed frame and the movable frame, and the screen to be opened and closed by winding and unwinding the screen around the winding axis with the forward and backward movement of the movable frame; and a screen guide formed so as to be long and bendable, going in and coming out of the inner portion of the fixed frame or the movable frame through the opening provided at the end portion of the fixed frame or the movable frame with the forward and backward movement of the movable frame, and linearly led out along the edge portion of the screen unwound from the winding axis and guiding the edge portion. In the winding-up screen device, a joining part is attached to the screen along the edge portion to be guided by the screen guide, the screen guide contains a plurality of guide parts in which a joining groove is provided in the axial direction on the inner surface disposed on the screen side and is formed by connecting neighboring guide parts at both sides sandwiching the joining groove on the inner surface so as to be bendable, and the joining part of the screen unwound from the winding axis is joined to the joining groove of the screen guide led out from the fixed frame or the movable frame so as to slide freely.

In this way, according to the winding-up screen device of the present invention, when the screen is wound around the winding axis to make the opening portion open, since the screen guide for guiding the end portion of the screen unwound from a winding axis is housed in the inner portion of the fixed frame or the movable frame and not left on the opening frame, the screen guide does not harm the external appearance and narrow the width and height of the opening, and accordingly, does not produce a problem to go in and out of a room through the opening frame.

Here, the joining part can be formed, for example, in such a way that a plurality of protrusion portions are fixed along one end of a tape-like part fixed to the edge portion of the screen.

Then, in the winding-up screen guide, the guide part contains a pair of connection holes passing through in the axial direction on both sides sandwiching the joining groove on the inner surface and neighboring guide parts may be connected to each other by making flexible wire parts pass through in the pair of connection holes, or the guide part contains a pair of convex portions and a pair of concave portions for housing the convex portions on both sides sandwiching the joining groove on the inner surface and neighboring guide parts may be connected to each other by making the rotational axes and the bearing holes provided in the convex portions and the concave portions mate with each other. At this time, it is desirable that convex bending toward the inner surface of the screen guide due to the contact of the end faces in the axial direction of neighboring guide parts be suppressed.

Furthermore, in the winding-up screen device, one end of the screen guide is fixed to the fixed frame and the screen guide goes in and out of the inner portion of the movable frame with the forward and backward movement of the movable frame, and wherein one end of the screen is held in the movable frame, and the winding axis holding the other end of the screen and winding the screen may be supported in the inner portion of the fixed frame so as to be rotational, or one end of the screen guide is fixed to the movable frame and the screen guide goes in and out of the inner portion of the fixed frame with the forward and backward movement of the movable frame, and one end of the screen is held in the fixed frame and the winding axis holding the other end of the screen and winding the screen may be supported in the inner portion of the movable frame so as to be rotational. Then, it is desirable that the guide part contain a concave groove sitting astride a guide rail provided in a protruding condition on the opening frame on the surface opposite to the inner surface so as to freely slide and that the screen guide led out on the opening frame be guided by the guide rail, because the slide operation of the screen guide is more stabilized.

Moreover, in the winding-up screen device, the screen is opened and closed by horizontal movement of the movable frame and the screen guide can be led out along the lower edge portion of the screen unwound from the winding axis. At this time, the screen device may be constructed in such a way that a slide part is contained at the upper end of the movable frame and the movable frame is suspended from a slide frame fixed to the upper frame of the opening frame by using the slide part so as to freely slide. However, it is possible that the screen guide may led out along both edge portions of the screen unwound from the winding axis.

Moreover, in the winding-up screen device, it is desirable that a wiring mechanism in which the tension of extended cords maintains the fixed frame and the movable frame in balance be contained, and it is also desirable to use the screen formed by using an insect prevention net as a window screen device.

BEST MODE FOR CARRYING OUT THE INVENTION

Figure 1:
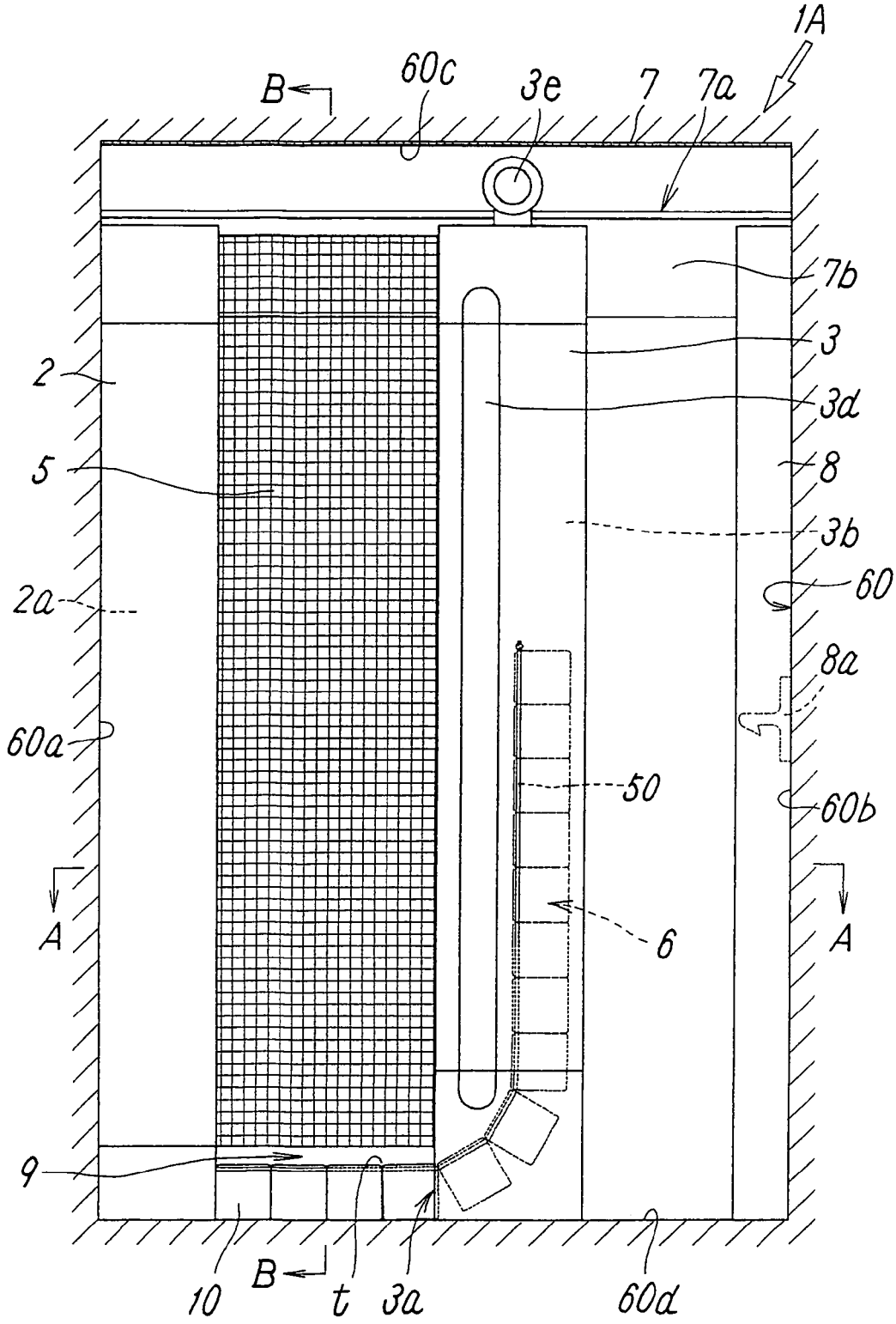
FIG. 1 is a front view showing a first embodiment of a winding-up screen device according to the present invention.
Figure 2A:
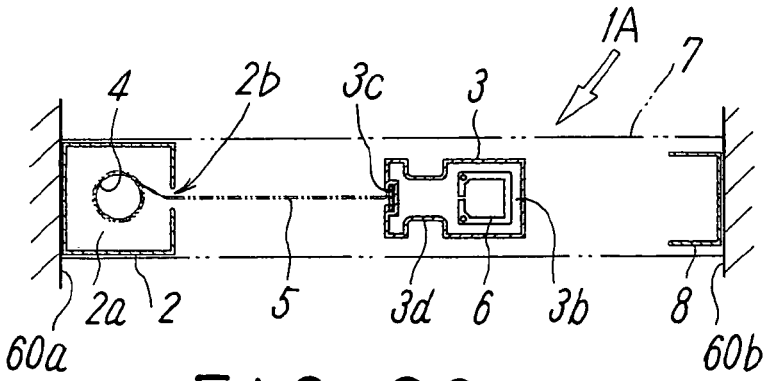
FIG. 2*a* is a sectional view taken on line A-A of FIG. 1.
Figure 2B:
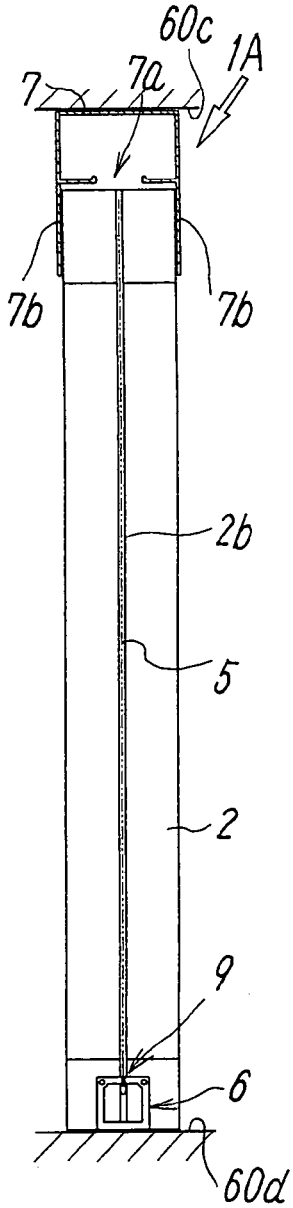
FIG. 2*b* is a sectional view taken on line B-B of FIG. 1.
Figure 2C:
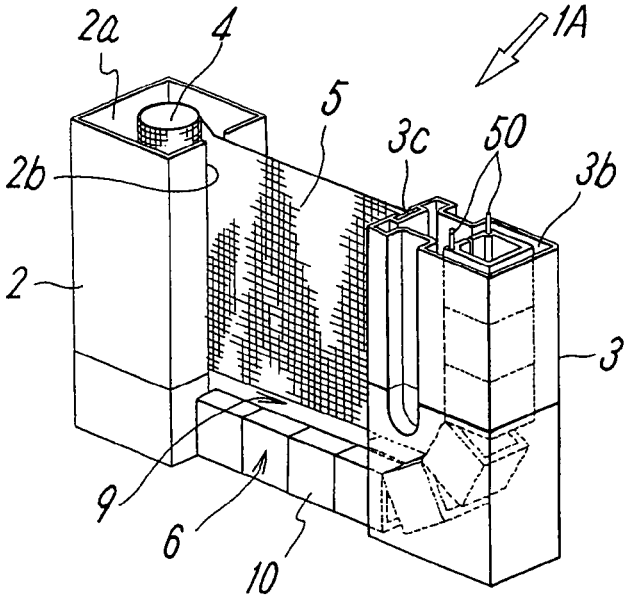
FIG. 2*c* is a perspective view of an essential part of FIG. 1.

Hereinafter, embodiments of a winding-up screen device according to the present invention are described in detail with reference to the drawings. However, in the following embodiments, although the winding-up screen device of the present invention used as an insect-prevention screen window to be horizontally opened and closed is described in detail, the winding screen device of the present invention is not limited to screen windows to be horizontally opened and closed, but also can be used as screen windows to be vertically opened and closed. Furthermore, its use is not limited to insect prevention, but also may be intended for shading, blindfold, heat insulation, etc.

First, a first embodiment of the winding-up screen device according to the present invention is described based on FIG. 1 and FIGS. 2*a* to 2*c*. A winding-up screen device 1A, which is attached to an opening frame 60 made up of a pair of vertical frames 60*a* and 60*b* and a pair of upper and lower frames 60*c* and 60*d* as in a window frame, an entrance and exit, etc., in a building and is opened and closed sideways, contains a fixed frame 2 to be fixed to one vertical frame 60*a* of the opening frame 60, a movable frame 3 parallel to the fixed frame 2 and movable back and forth between the pair of vertical frames 60*a* and 60*b*, the screen 5 wound around a winding axis 4 inside the fixed frame 2, extended between the fixed frame 2 and the movable frame 3, and opened and closed in such a way that the screen 5 is wound around the winding axis 4 and unwound from that with the forward and backward operation of the movable frame 3, a screen guide 6 going in and out of the movable frame 3 with the forward and backward operation of the movable frame 3 and for guiding the lower edge portion of the screen unwound from the winding axis 4, a slide frame 7 for suspending the movable frame 3 so as to freely move in the operation direction, and a latch frame 8 fixed to the other vertical frame 60*b* of the opening frame 60 and for latching the movable frame 3 so as to be latched and be free from the latch.

The screen guide 6 is long and made bendable, one end of the screen guide 6 is fixed to the lower end portion of the fixed frame 2, and the other end as a free end is disposed in the inner portion 3*b* of the movable frame 3, and the screen guide 6 goes in and out of the inner portion 3*b* through an opening 3*a* provided at the lower end portion of the movable frame 3 with the opening and closing operation of the movable frame 3. Then, when the screen 5 is unwound from the winding axis 4 by the closing operation of the movable frame 3 (operation to the right in FIG. 1), the screen guide 6 is simultaneously linearly led out from the inside of the movable frame 3 on the lower frame 60*d* of the opening frame 60 along the lower edge portion of the screen 5 so as to guide the edge portion.

Furthermore, the latch frame 8 is formed so as to be substantially U-shaped in section, a latch portion 8*a* is provided in the latch frame 8, and the screen 5 unwound from the winding axis 4 is held in the opening frame 60 by latching the closed movable frame 3 to the latch portion 8*a* so as to be able to be made free again.

Figure 3A:
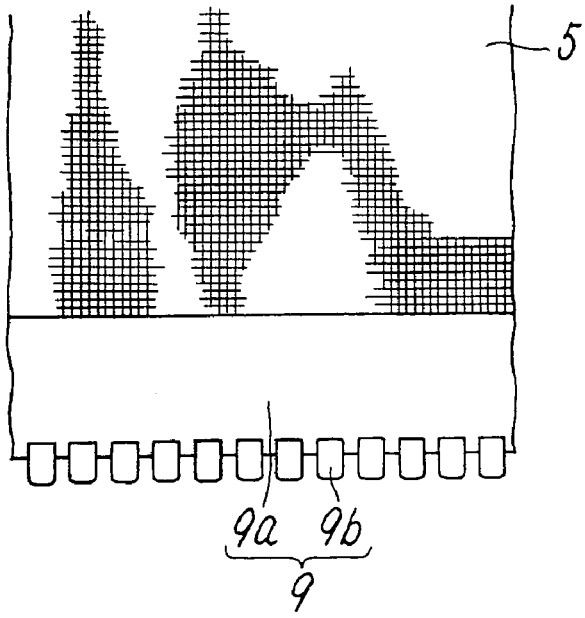
FIG. 3*a* is a partially enlarged view of FIG. 1, showing an edge portion of a screen to which a joining part is attached.
Figure 3B:
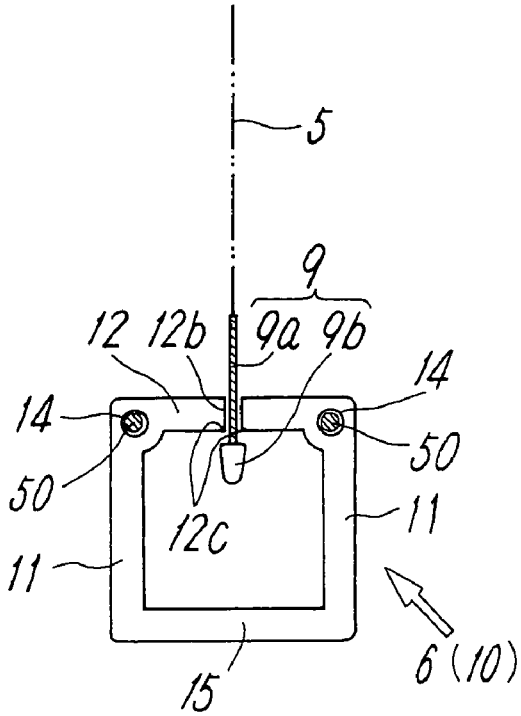
FIG. 3*b* is a partially enlarged sectional view of FIG. 1, showing the state in which a joining part is joined to a joining groove of a screen guide so as to freely slide and the edge portion of a screen is guided by the screen guide.

The screen 5 is made up of an insect-prevention net and, as shown in FIG. 3*a* and FIG. 3*b*, a joining part 9 is attached along the lower edge portion. Furthermore, in the screen guide 6, a joining groove 12*b* is provided on the inner surface 12*a* facing the lower edge portion of the screen 5 along the axial direction. Then, the joining part 9 of the screen 5 extended from the winding axis 4 is joined to the joining groove 12*b* guided out from the movable frame 3 so as to freely move. That is, the joining part 9 is joined to the joining groove 12*b* so as to be not able to be pulled out in the opening direction and to freely pass through in the length direction.

Accordingly, when the screen 5 as an insect-prevention net is unwound from the winding axis 4 by the closing operation of the movable frame 3, since no space is formed between the lower edge portion of the screen 5 and the screen guide 6 and between the screen guide 6 and the lower frame 60*d* in such a way that the joining part 9 of the screen 5 is joined to the joining groove 12*b* of the screen guide 6 guided out on the lower frame 60*d* so as to freely slide, it is able to prevent insects such as mosquitoes, flies, etc., from entering the room therefrom. Moreover, when the screen 5 is wound around the winding axis 4 by the opening operation (operation to the left direction in FIG. 1) of the movable frame 3, since the screen guide 6 is housed inside the movable frame 3 and not left on the lower frame 60*d* of the opening frame 60, the external appearance is not harmed and the opening height is not reduced because of the screen guide 6, and also the screen guide 6 does not prevent any one from entering a room through the opening frame 60.

When described more concretely, the above fixed frame 2 is hollow and, in its inner portion 2*a*, the above winding axis 4 for holding one end in the horizontal direction of the above screen 5 and winding the screen 5 is supported so as to be rotated. Then, a slit-shaped opening 2*b* for putting in and out the screen 5 is provided on the surface facing the movable frame 3 of the fixed frame 2 in the vertical direction (in the axial direction of the fixed frame 2), and, at the lower end portion of the surface, one end of the screen guide 6 is fixed so that the bottom surface of the screen guide 6 may be flush with the lower end surface of the fixed frame 2. Here, an automatic winding mechanism using a coil spring (not illustrated) is contained in the winding axis 4, a returning rotational force is stored in the coil spring when the screen 5 is unwound by the closing operation of the movable frame 3, and the screen 5 is made to be able to be wound around the winding axis 4 in such a way that the coil spring where the rotational force is stored becomes a driving force.

Additionally, the movable frame 3 is also hollow, a joining groove 3*c* for holding the other end in the horizontal direction of the screen 5 is provided on the surface facing the fixed frame 2 in the vertical direction (in the axial direction of the movable frame 3), and handle concave grooves 3*d* for the opening and closing operation are provided on both sides. Then, an opening 3*a* for making the screen guide 6 move in and out of the inner portion 3*b* of the movable frame 3 is provided in the lower end portion on the surface facing the fixed frame 2; when the screen 5 is wound around the winding axis inside the fixed frame 2 by the opening operation of the movable frame 3, the screen guide 6 one end of which is fixed to the fixed frame 2 is housed in the inner portion 3*b* of the movable frame 3 starting with the other end as its free end; and, when the screen 5 is unwound from the winding axis 4 by the closing operation of the movable frame 3, the screen guide 6 housed in the inner portion 3*b* of the movable frame 3 is linearly led out on the lower frame 60*d* of the opening frame 60 from the opening 3*a* along the lower edge portion of the screen 5 to guide the edge portion of the screen 5.

Furthermore, a slide part 3*e* made up of a roller, etc., is provided at the upper end of the movable frame 3 and the movable frame 3 is suspended from the slide frame 7 so as to freely slide in such a way that the slide part 3*e* is joined to a slide rail 7*a* having an opening on the lower side of the slide frame 7 so as to freely slide. Moreover, the slide frame 7 is formed so as to be open downwards and substantially U-shaped in section, and both sides of the upper portion of the movable frame 3 are guided by a pair of guide walls opposite to each other.

The joining part 9 is composed of a tape-like part 9*a* and a plurality of protrusion portions 9*b* fixed along one end of the tape-like part 9*a* so as to be like a fastener, as shown in FIG. 3*a* and FIG. 3*b*, and the joining part 9 is attached to the edge portion of the screen 5 by fixing the tape-like part 9*a* along the lower edge portion of the screen 5 by welding, sticking, etc.

Figure 4A:
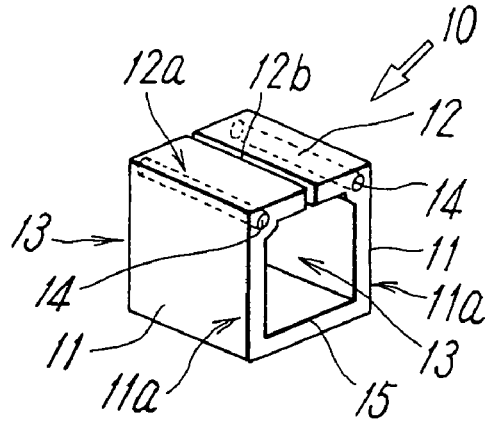
FIG. 4*a* is an enlarged perspective view of a guide part of FIG. 1.
Figure 4B:
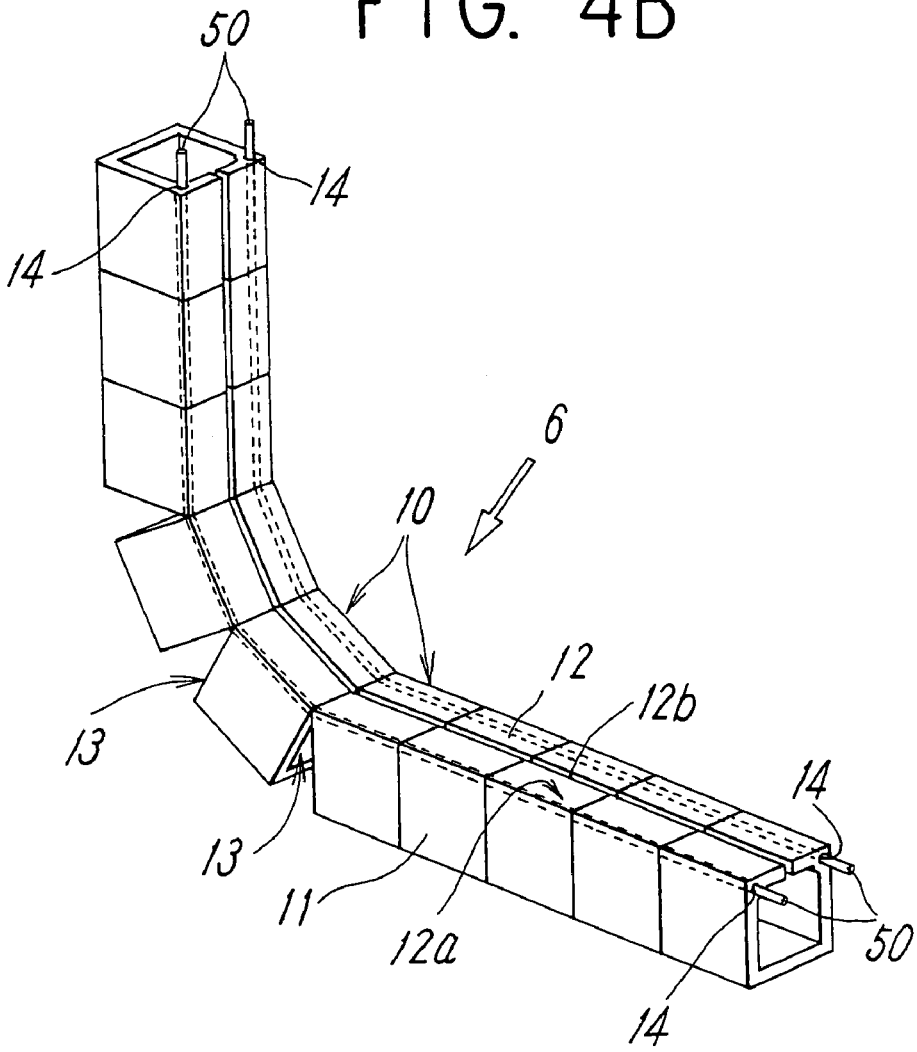
FIG. 4*b* is an enlarged perspective view of a screen guide of FIG. 1.
Figure 5:
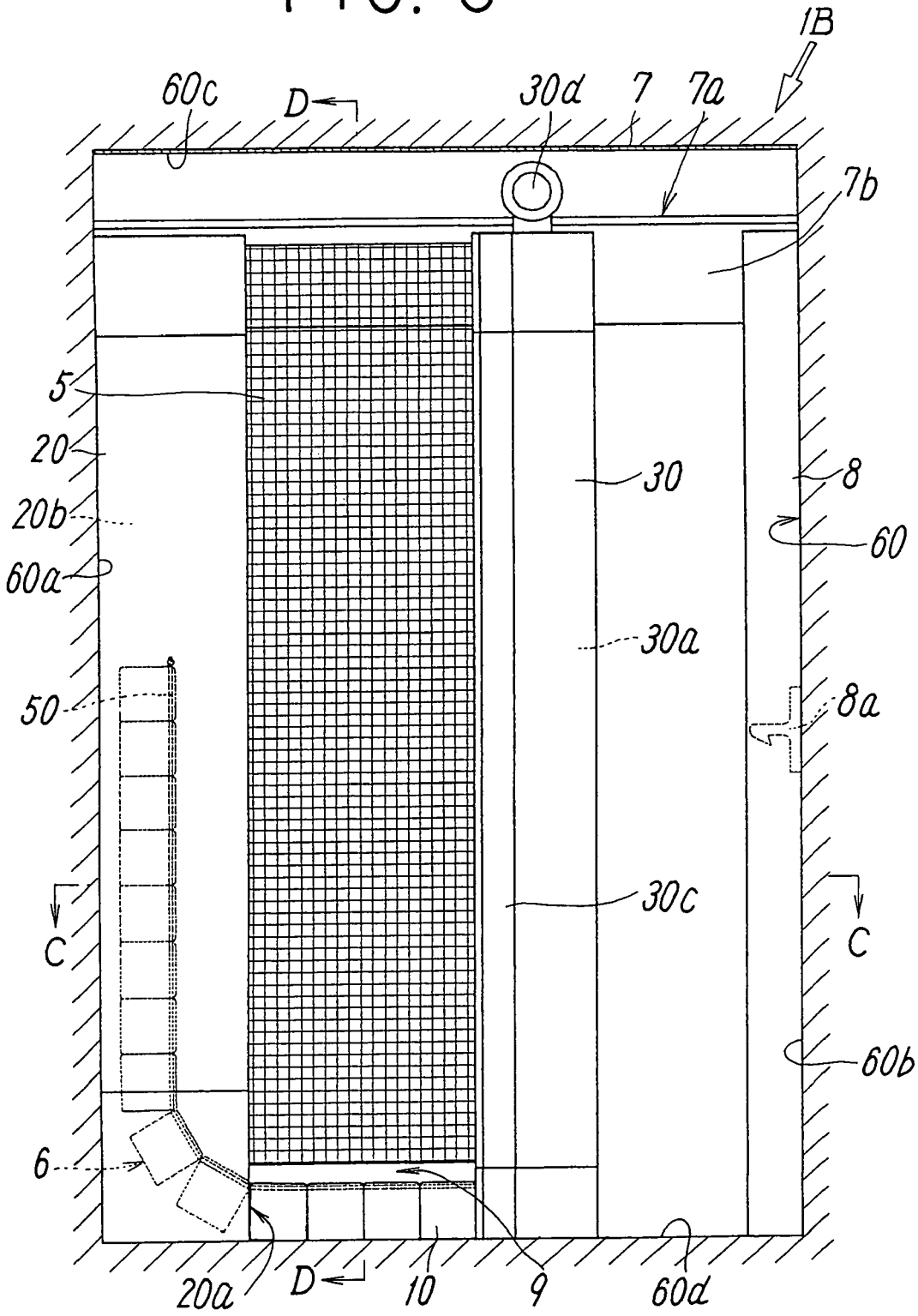
FIG. 5 is a front view showing a second embodiment of the winding-up screen device according to the present invention.
Figure 6A:
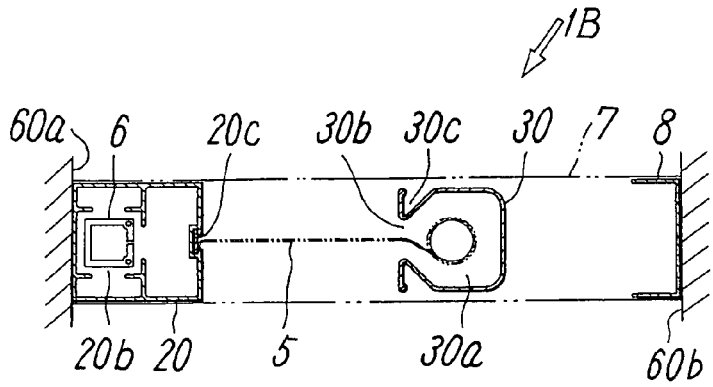
FIG. 6*a* is a sectional view taken on line C-C of FIG. 5.
Figure 6B:
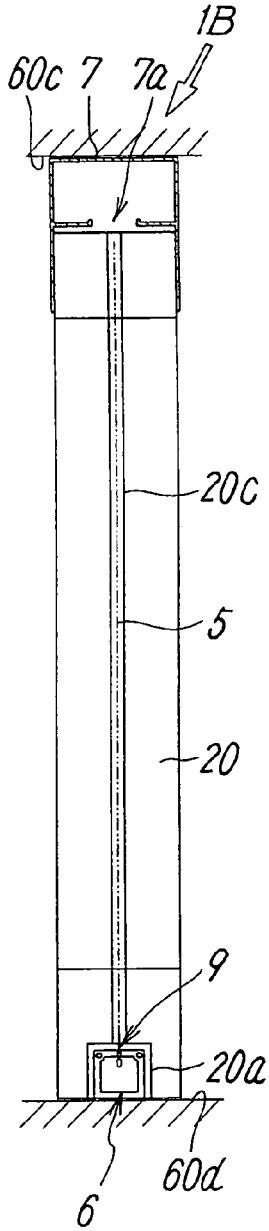
FIG. 6*b* is a sectional view taken on line D-D of FIG. 5.
Figure 6C:
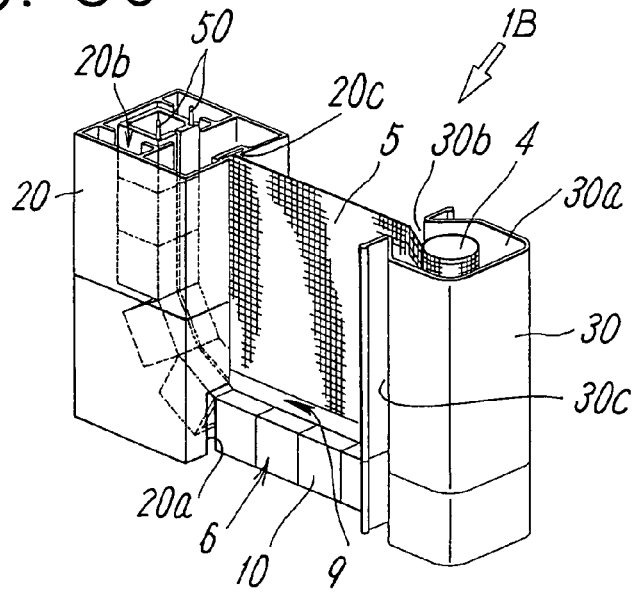
FIG. 6*c* is a perspective view of an essential part of FIG. 5.

The screen guide 6 is composed of a plurality of guide parts 10, as shown in FIG. 4*a* and FIG. 4*b*, and formed by connecting these guide parts in a line using flexible wire parts 50.

The guide part 10 has a pair of side faces 11*a* and 11*a* and an inner surface 12*a* which is located between the upper portions of the pair of side faces 11*a* and 11*a* and is to be disposed on the screen side and has the joining groove 12*b* provided substantially in the middle of the inner surface 12*a*. Furthermore, connection holes 14 and 14 are provided along the joining groove 12*b* so as to pass through in the axial direction on both side portions sandwiching the joining groove 12*b* on the inner surface 12*a* of the guide part 10.

Then, the plurality of guide parts 10 are connected by passing the wire parts 50 and 50 through the connection holes 14 and 14 so as to be bendable toward the side of the inner surface 12*a*, that is, toward the side of the screen 5 to form the screen guide 6. Accordingly, the whole screen guide 6 is made possible to be bent so as to be concave toward the inner surface 12*c*, that is, toward the screen 5 to be guided.

More concretely, the guide parts 10, which are formed by injection molding of synthetic resin, are composed of a pair of side walls 11 and 11 forming the pair of side faces 11*a* and 11*a*, an inner wall 12 disposed between the upper end portions of the side walls and forming the inner surface 12*a*, and a connection wall 15 provided so as to hang between the pair of side walls 11 and 11 and connecting these to be formed in the axial direction and hollow and substantially rectangular in section. Then, each of the pair of side walls 11 and 11, the inner wall 12, and the connection wall 15 constituting the guide parts 10 is formed so as to be like a substantially rectangular plate, and the connection holes 14 are provided so as to pass through along both corner portions where the pair of side walls 11 and 11 intersect the inner wall 12. Moreover, the end portions of wire parts 50 and 50 are made to pass through the connection holes 14 and 14 and connect the guide parts 10 are properly treated so as not to be pulled out. Furthermore, the joining groove 12*b* is provided substantially in the middle of the inner wall 12 so as to pass through in the thickness direction. As shown in FIG. 3*b*, the tape-like part 9*a* of the joining part 9 attached to the end portion of the screen 5 is made to pass through the joining groove 12*b* so as to freely slide in the axial direction, the base portion of the protrusion portion 9*b* of the joining part 9 is made wider in width than the groove of the joining groove 12*b*, and the end portion of the screen 5 is joined so as to freely slide between opening edges 12*c* of the inner wall 12 of the joining groove 12*b*. Thus, the end portion of the screen 5 is guided by the screen guide 6.

Now, when the screen guide 6 is linearly led out along the edge portion of the screen 5 unwound from the winding axis 4 on the opening frame 60, the guide parts 10 are connected in such a way that the end faces 13 in the axial direction of neighboring guide parts 10 are made in contact with each other and disposed without a space therebetween. Therefore, the convex bending of the screen guide 6 toward the side of the screen 5 (the side of the inner surface 12*a*), that is, the floating of the screen guide 6 from the opening frame 60 is prevented as much as possible.

Moreover, in such a screen guide 6, when the screen guide 6 is put in and out of the inner portion 3*b* of the movable frame 3, it becomes possible to bend the screen guide 6 so as to be smoothly concave-shaped toward the side of the screen 5 (side of the inner surface 12*a*) in such a way that the wire part 50 is made slightly longer than the actual length of many connected guide parts 10 in accordance with the position of the connection hole 14 with reference to the inner surface 12*a* or that a tapered cut portion t as shown in FIG. 1 is formed in the corner portion where the inner surface 12*a* and the end face 13 cross in the guide part 10.

FIG. 5 and FIGS. 6*a* to 6*c* show a second embodiment of the winding-up screen device according to the present invention. Here, only the construction portions different from the winding-up screen device of the first embodiment are described and the other common construction parts are given the same reference numerals to avoid overlapping description.

The main difference of the screen device 1B of the second embodiment from the screen device 1A is in that one end of the screen guide 6 is fixed to the lower end portion of a movable frame 30 and the screen guide 6 goes in and out of the inner portion 20*b* of the fixed frame 20 through the opening 20*a* provided in the lower end portion of the fixed frame 2*d* with the opening and closing operation of the movable frame 30 and that one end in the horizontal direction of the screen 5 is held, the winding axis 4 for winding the screen 5 is supported inside the movable frame 30 so as to be able to be rotated, and the other end in the horizontal direction of the screen 5 is held in the fixed frame 20.

Concretely, the movable frame 30 is formed so as to be hollow and, in its inner portion 30*a*, the winding axis 4 is supported so as to be able to be rotated. Then, a slit-shaped opening 30*b* for putting in and out the screen 5 is provided on the surface facing the fixed frame 20 of the movable frame 30 in the vertical direction, and, at the lower end portion of the surface, one end of the screen guide 6 is fixed so that the bottom surface of the screen guide 6 may be flush with the lower end surface of the movable frame 30. Furthermore, handle grooves (concave parts) 30*c* for opening and closing operation are provided on both side faces of the movable frame 30. Moreover, a slide part 30*d* made up of a roller, etc., is provided at the upper end of the movable frame 30, and the movable frame 30 is suspended from the slide frame 7 so as to freely slide in such a way that the slide part 30*d* is joined to a slide rail 7*a* having an opening on the lower surface side of the slide frame 7 so as to freely slide.

Additionally, fixed frame 20 is also formed so as to be hollow, a joining groove 20*c* for holding the other end in the horizontal direction of the screen 5 is provided in the vertical direction (in the axial direction of the fixed frame 20) on the surface facing the movable frame 30 of the fixed frame 20, and an opening 20*a* for putting the screen guide 6 in and out of the inner portion 20*b* of the fixed frame 20 is provided at the lower end portion of the surface.

Then, when the screen 5 is wound around the winding axis 4 inside the movable frame 30 by opening operation of the movable frame 30, the screen guide 60 one end of which is fixed to the movable frame 30 is housed in the inner portion 20*b* of the fixed frame 20 starting with the other end side through the opening 20*a*, and, in contrast with this, when the screen 5 is unwound from the winding axis 4 by closing operation of the movable frame 30, the screen guide 6 housed in the inner portion 20*b* of the fixed frame 20 is linearly led out along the lower edge portion of the screen 5 on the lower frame 60*d* of the opening frame 60 through the opening 20*a* to guide the edge portion of the screen 5.

Figure 7:
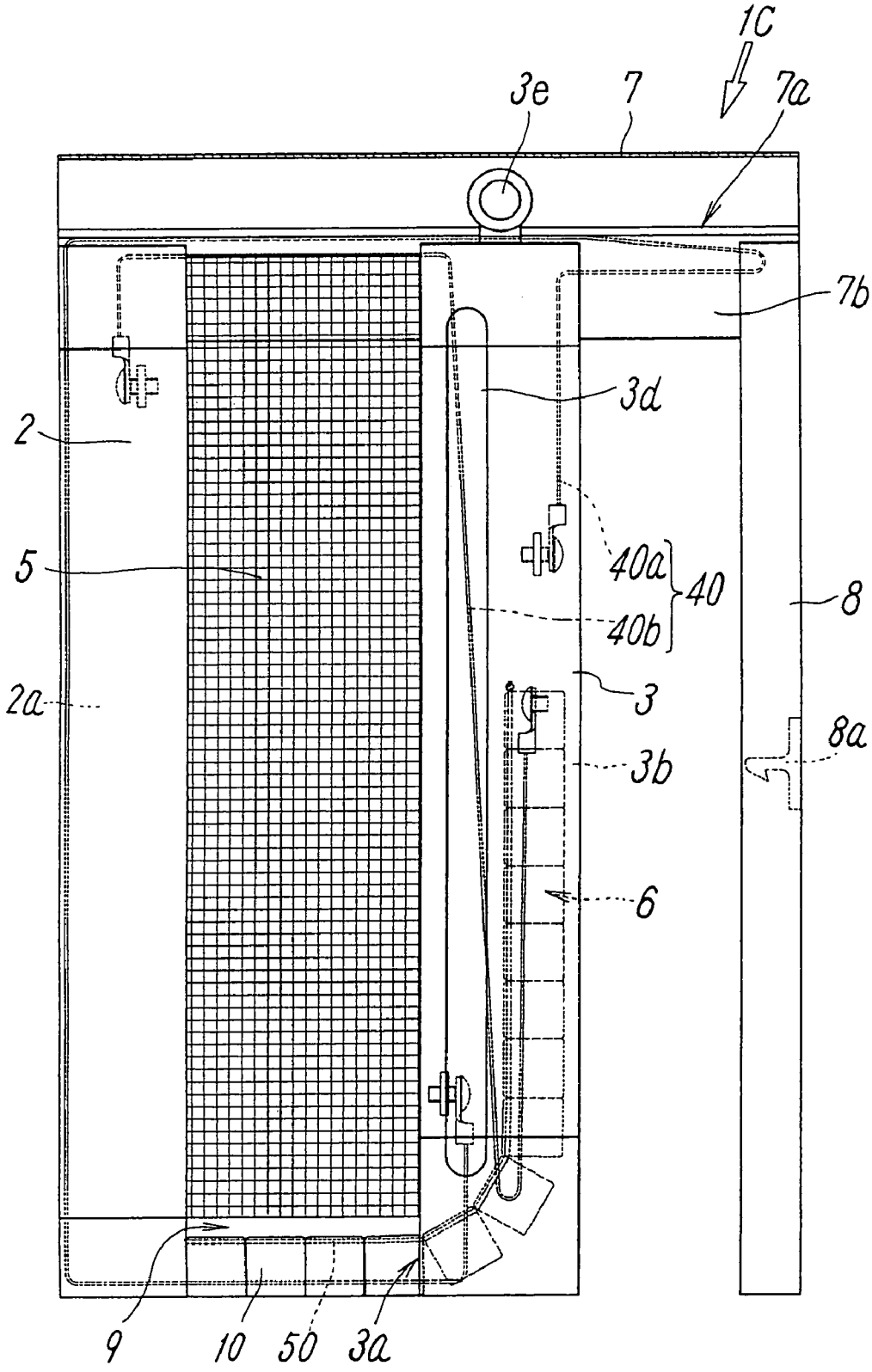
FIG. 7 is a front view showing a third embodiment of the winding-up screen device according to the present invention.
Figure 8:
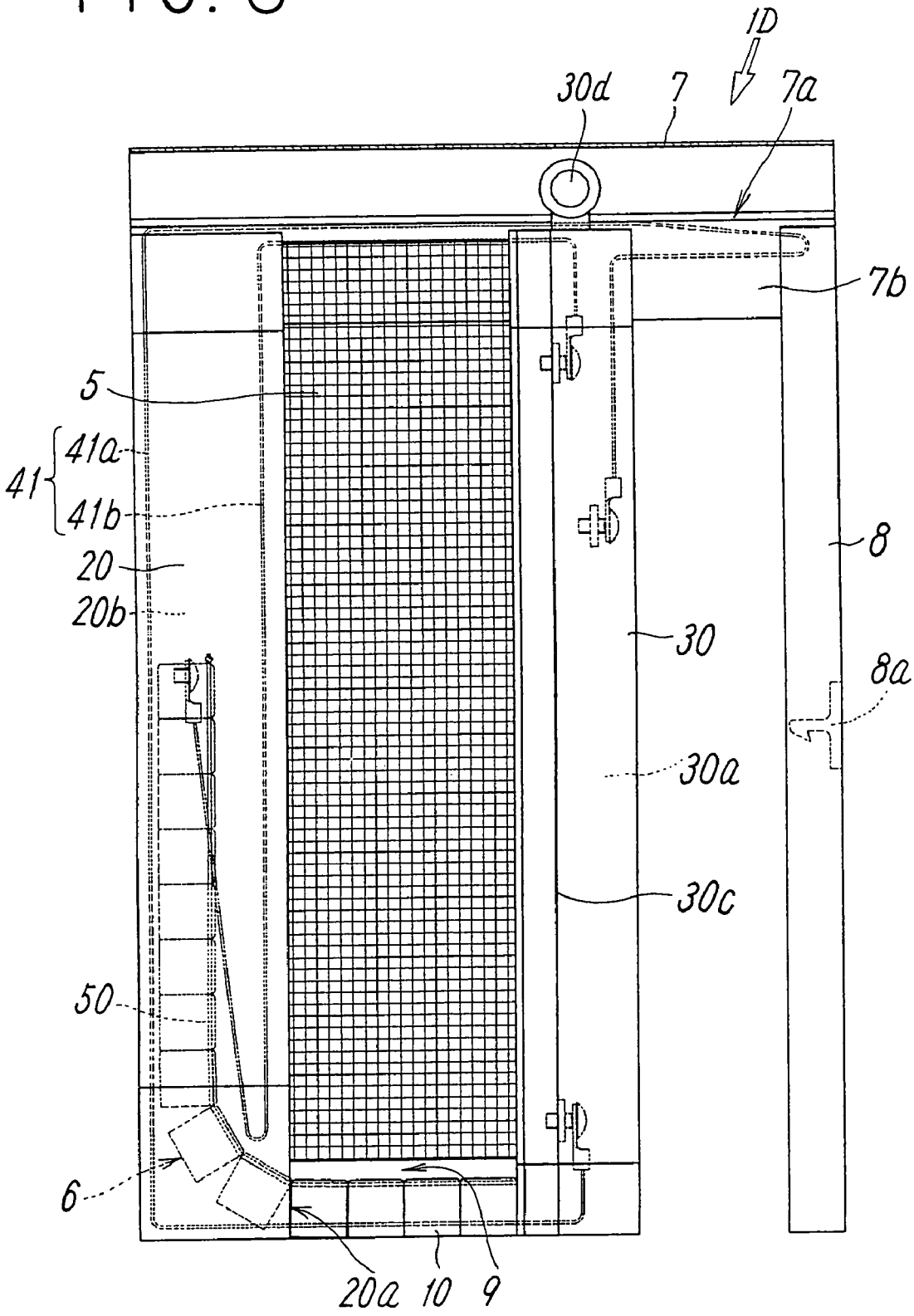
FIG. 8 is a front view showing a fourth embodiment of the winding-up screen device according to the present invention.

FIG. 7 shows a third embodiment of the winding-up screen device according to the present invention. Here, only the construction portions different from the winding-up screen device 1A of the first embodiment are described and the other common construction parts are given the same reference numerals to avoid overlapping description.

The main difference of the screen device 1C of the third embodiment from the screen device 1A is in that a wiring mechanism 40 in which extended cords 40*a* and 40*b* are hung to maintain the fixed frame 2 and the movable frame 3 in parallel with their tension is provided.

Concretely, one end of a first extended cord 40*a* is fixed to the inner portion 3*b* of the movable frame 3, the cord 40*a* is led to the upper portion of the movable frame 3, the cord 40*a* makes a turn at the upper end portion of the movable frame 3, the cord 40*a* is laid to the upper end portion of the latch frame 8 along the upper end portion of the screen device 1C, the cord 40*a* turns back at the upper end portion of the latch frame 8, the cord 40*a* is laid to the upper end portion of the fixed frame 2 along the upper end portion of the screen device 1C, the cord 40*a* makes a turn at the upper end portion of the fixed frame 2, the cord 40*a* is led to the lower end portion of the inner portion 2*a* of the fixed frame 2, the cord 40*a* makes a turn at the lower end portion of the fixed frame 2, the cord 40*a* is laid to the lower end portion of the movable frame 3 along the lower end portion of the screen device 1C, the cord 40*a* makes a turn at the lower end portion of the movable frame 3, and the other end is fixed to the inner portion 3*b* of the movable frame 3.

One end of a second extended cord 40*b* is fixed to the guide part 10 (free end of the screen guide 6) connected to the end of the movable frame 3 of the screen guide 6, the cord 40*b* is led to the lower end portion of the movable frame 3, the cord 40*b* turns back at the lower end portion of the movable frame 2, the cord 40*b* is led to the upper portion of the inner portion 3*b* of the movable frame 3, the cord 40*b* makes a turn at the upper end portion of the movable frame 3, the cord 40*b* is laid to the upper end portion of the fixed frame 2 along the upper end portion of the screen device 1C, the cord 40*b* makes a turn at the upper end portion of the movable frame 3, and the other end of the cord 40*b* is fixed to the inner portion 2*a* of the fixed frame 2. screen device according to the present invention. Here, only the construction portions different from the winding-up screen device 1B of the second embodiment are described and the other common construction parts are given the same reference numerals to avoid overlapping description.

The main difference of the screen device 1D of the fourth embodiment from the screen device 1B is in that a wiring mechanism 41 in which extended cords 41*a* and 41*b* are hung to maintain the fixed frame 20 and the movable frame 30 in parallel with their tension is provided.

Concretely, one end of a first extended cord 41*a* is fixed to the inner portion 30*a* of the movable frame 30, the cord 41*a* is led to the upper portion of the movable frame 30, the cord 41*a* makes a turn at the upper end portion of the movable fame 30, the cord 41*a* is laid to the upper end portion of the latch frame 8 along the upper end portion of the screen device 1D, the cord 41*a* turns back at the upper end portion of the latch frame 8, the cord 41*a* is laid to the upper end portion of the fixed frame 20 along the upper end portion of the screen device 1D, the cord 41*a* makes a turn at the upper end portion of the fixed frame 20, the cord 41*a* is led to the lower end portion of the inner portion 20*b* of the fixed frame 20, the cord 41*a* makes a turn at the lower end portion of the fixed frame 20, the cord 41*a* is laid to the lower end portion of the movable frame 30 along the lower end portion of the screen device 1D, the cord

41*a* makes a turn at the lower end portion of the movable frame 30, and the other end of the cord 41*a* is fixed to the inner portion 30*a* of the movable frame 30.

One end of a second extending cord 41*b* is fixed to the inner portion 30*a* of the movable frame 30, the cord 41*b* is led to the upper end portion of the movable frame 30, the cord 41*b* makes a turn at the upper end portion of the movable frame 30, the cord 41*b* is laid to the upper end portion of the fixed frame 20 along the upper end portion of the screen device ID, the cord 41*b* makes a turn at the upper end portion of the fixed frame 20, the cord 41*b* is led to the lower end portion of the inner portion 20*b* of the fixed frame 20, the cord 41*b* turns back at the lower end portion of the fixed frame 20, and the other end of the cord 41*b* is fixed to the guide part 10 (free end of the screen guide 6) connected to the very end in the fixed frame 20 of the screen guide 6.

Figure 9A:
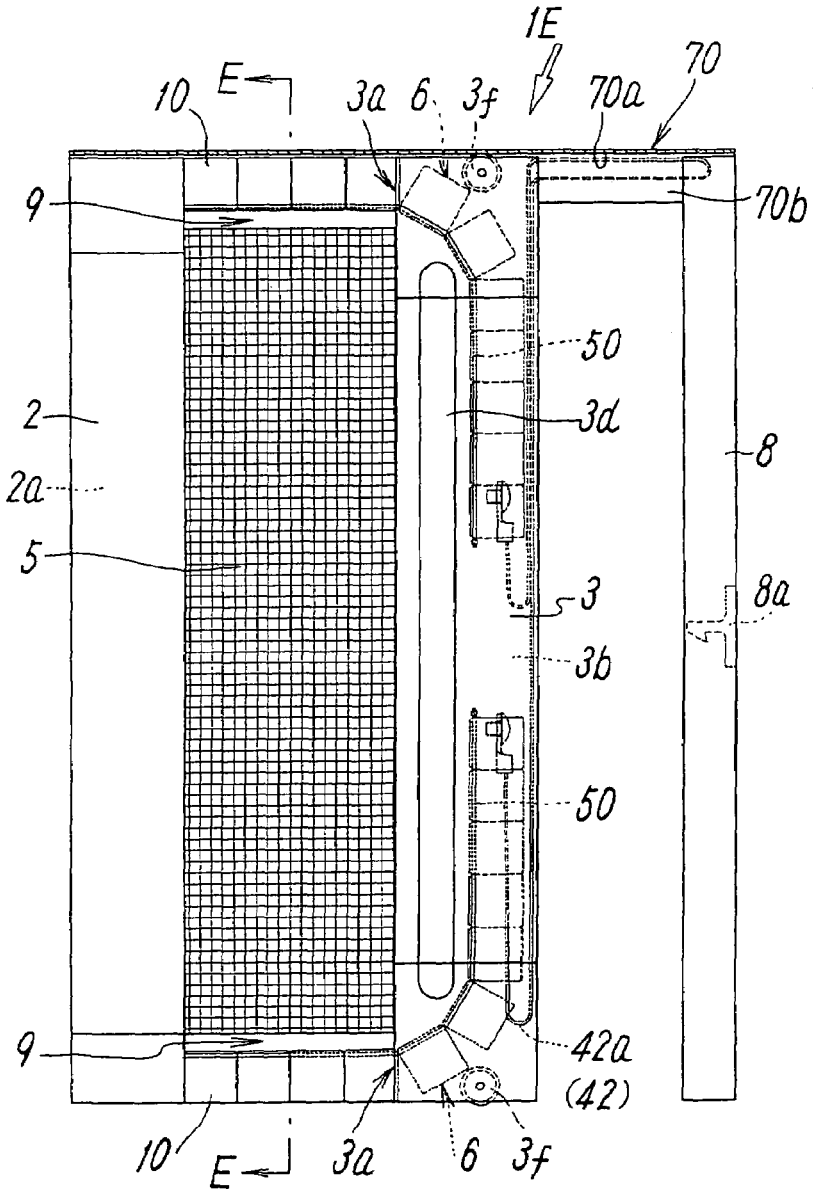
FIG. 9*a* is a front view showing a fifth embodiment of the winding-up screen device according to the present invention.
Figure 9B:
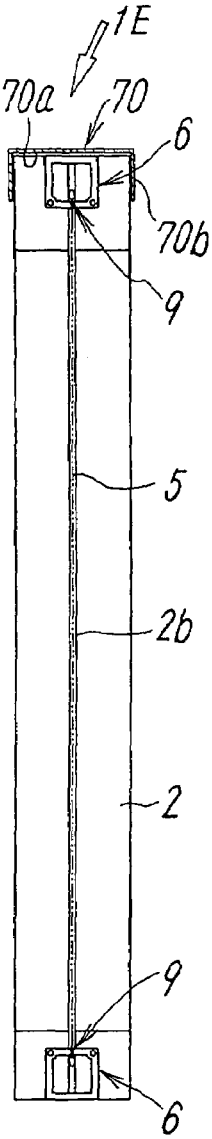
FIG. 9*b* is a sectional view taken on line E-E of FIG. 9*a*.

FIGS. 9*a* and 9*b* show a fifth embodiment of the winding-up screen device according to the present invention. Here, only the construction portions different from the winding-up screen device 1A of the first embodiment are described and the other common construction parts are given the same reference numerals to avoid overlapping descriptions.

The main difference of the screen device 1E of the fifth embodiment from the screen device 1A is in that a pair of screen guides 6 and 6 is provided to go in and out of the opening 3*a* and 3*a* at the lower end portion and the upper end portion of the movable frame 3 in accordance with the opening and closing operation of the movable frame 3, the screen guides 6 and 6 are led out along both upper and lower edge portions of the screen 5 unwound from the winding axis 4 in the fixed frame 2, and both edge portions are guided, and that a wiring mechanism in which an extended cord 42*a* is hung to maintain the fixed frame 2 and the movable frame 3 in parallel with its tension is provided.

Concretely, in the fixed frame 2 in the inner portion 2*a* of which the winding axis 4 is supported, one ends of the pair of screen guides 6 and 6 are fixed to the upper end portion and lower end portion of the surface facing the movable frame 3 in such a way that the bottom surface of the screen guides 6 and 6 is flush with the upper end surface and the lower end surface of the fixed frame 2.

In the movable frame 3, a pair of openings 3*a* and 3*a*, which make the pair of screen guides 6 and 6 go in and out of the inner portion 3*b* of the movable frame 3, is provided in the upper end portion and lower end portion of the surface facing the fixed frame 2.

Then, when the screen 5 is wound around the winding axis 4 inside the fixed frame 2 by the opening operation of the movable frame 3, the pair of screen guides 6 and 6 one end of which is fixed to the fixed frame 2 are housed in the inner portion 3*b* of the movable frame 3 starting with the other end through the openings 3*a* and 3*a*, and, in contrast with this, when the screen 5 is unwound from the winding axis 4 by the closing operation of the movable frame 3, a pair of screen guides 6 and 6 housed in the inner portion 3 of the movable frame 3 is linearly led out from the openings 3*a* and 3*a* onto the upper frame 60*c* and the lower frame 60*d* of the opening frame 60 along the upper and lower end portions of the screen 5 to guide both end portions.

Moreover, a pair of rollers 3*f* and 3*f* are provided at the upper and lower ends of the movable frames 3, and a slide frame 70 which is substantially U-shaped in section is mounted on the upper frame 60*c* of the opening frame 60 so as to be open downward. Then, on the upper end of the movable frame 3, the roller 3*f* rolls on the bottom surface 70*a* of the slide frame 70 and both side faces of the movable frame 3 are guided by a pair of guide walls 7*b*, facing each other, of the slide frame 70. Additionally, on the lower end of the movable frame 3, the roller 3*f* rolls on the lower frame 60*d* of the opening frame 60.

Furthermore, one end of the extended cord 42*a* is fixed to the guide part 10 (free end of the upper screen guide 6) connected to the very end in the movable frame 3 of the upper screen guide 6, the cord 42*a* turns back upward at the substantially middle portion in the inner portion 3*b* of the movable frame 3, the cord 42*a* is led to the upper end portion of the movable frame 3, the cord 42*a* makes a turn at the upper end portion of the movable frame 3, the cord 42*a* is laid to the upper end portion of the latch frame 8 along the upper end portion of the screen device 1E, the cord 42*a* turns back at the upper end portion of the latch frame 8, the cord 42*a* is laid to the upper end portion of the movable frame 3, the cord 42*a* makes a turn downward at the upper end portion of the movable frame 3, the cord 42*a* is led to the lower end portion of the inner portion 3*b* of the movable frame 3, the cord 42*a* turns back upward at the lower end portion of the movable frame 3, and the other end of the cord 42*a* is fixed to the guide part 10 (free end of the lower screen guide 6) connected to the very end of the movable frame 3 of the screen guide 6.

Figure 10A:
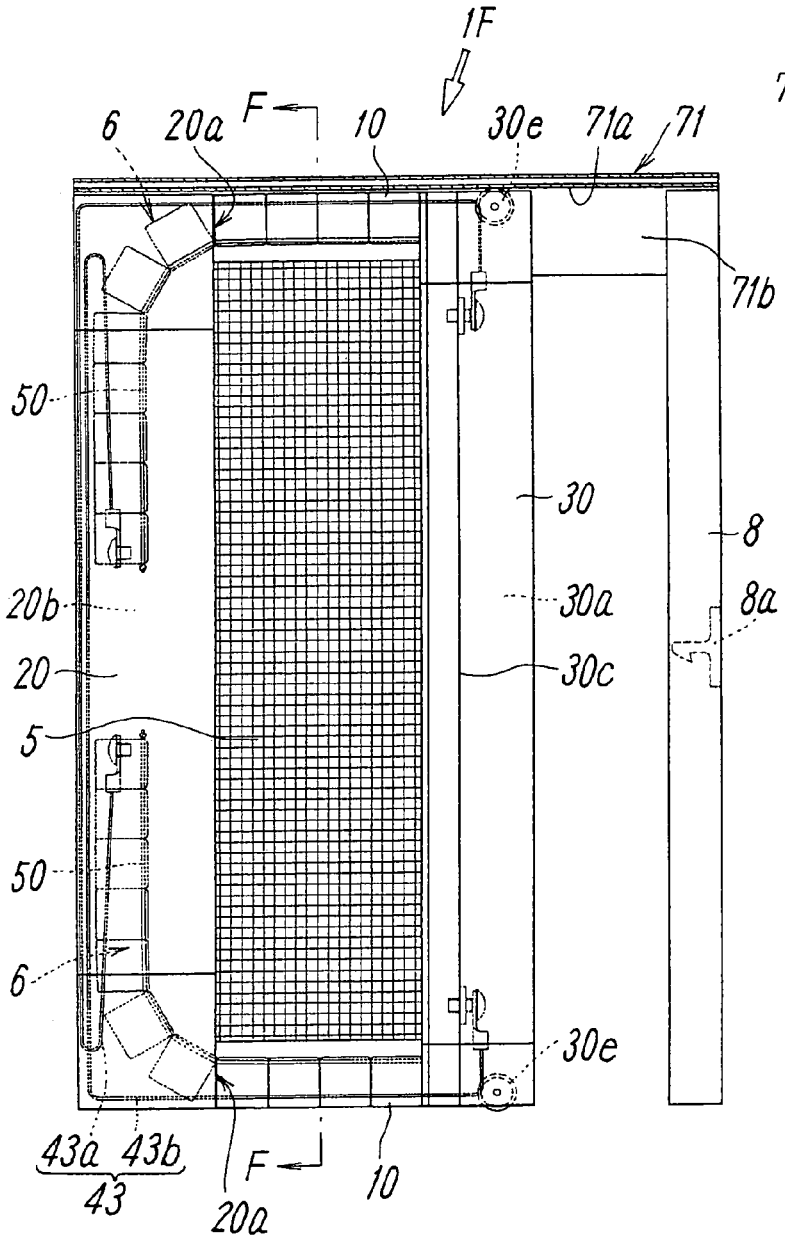
FIG. 10*a* is a front view showing a sixth embodiment of the winding-up screen device according to the present invention.
Figure 10B:
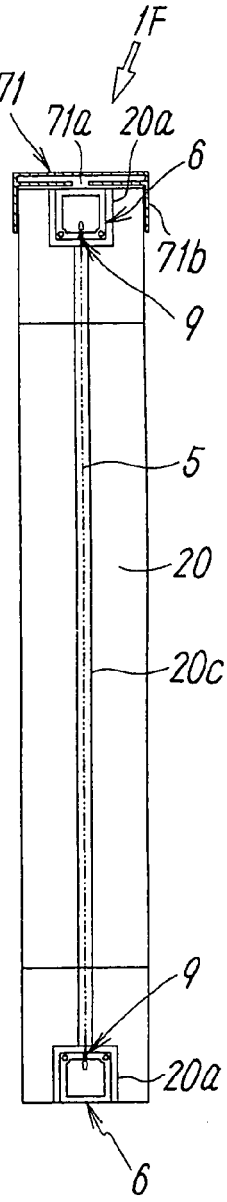
FIG. 10*b* is a sectional view taken on line F-F of FIG. 10*a*.

FIG. 10*a* and FIG. 10*b* show a sixth embodiment of the winding-up screen device according to the present invention. Here, only the construction portions different from the winding-up screen device 1B of the second embodiment are described and the other common construction parts are given the same reference numerals to avoid overlapping description.

The main difference of the screen device 1F of the sixth embodiment from the screen device 1B is in that, in accordance with the opening and closing operation of the movable frame 30, a pair of screen guides 6 and 6 are provided so as to be bent and go in and out of the inner portion 20*b* through the openings 20*a* and 20*a* of the lower end portion and upper end portion of the fixed frame 20 and, in accordance with the closing operation of the movable frame 30, the screen guides 6 and 6 are led out along the upper and lower edge portions of the screen 5 unwound from the winding axis 4 inside the movable frame 30 to be constituted so as to guide both end portions, and that a wiring mechanism 43 in which extended cords 43*a* and 43*b* provided to maintain the fixed frame 20 and the movable frame 30 in balance by their tension is contained.

Concretely, in the movable frame 30 in the inner portion 30*a* of which the above winding axis is supported, one end of the pair of screen guides 6 and 6 is fixed to the upper end portion and the lower end portion of the surface facing the fixed frame 20 so as to be substantially flush with the upper end surface and the lower end surface of the movable frame 30, respectively.

The pair of openings 20*a* and 20*a* where the pair of screen guides 6 and 6 go in and out of the inner portion 20*b* of the fixed frame 20 are provided at the upper end portion and lower end portion of the surface facing the movable frame 30 of the above fixed frame 20.

Then, when the screen 5 is wound around the winding axis 4 inside the movable frame 30 by the opening operation of the movable frame 30, the pair of screen guides 6 and 6 one end of which is fixed to the movable frame 30 is housed in the inner portion 20*b* of the fixed frame 20 starting with the other end of them through the openings 20*a* and 20*a*, and in contrast with this, when the screen 5 is unwound from the winding axis 4 by the closing operation of the movable frame 30, the pair of screen guides 6 and 6 housed in the inner portion 20*b* of the fixed frame 20 is linearly led out on the upper frame 60*c* and the lower frame 60*d* of the opening frame 60 along the upper and lower edge portions of the screen 5 from the openings 20*a* and 20*a* to guide both edge portions.

Moreover, a pair of rollers 30*e* and 30*e* are provided at the upper and lower ends of the movable frame 30, and a slide frame 71, which is substantially U-shaped in section, having a rail groove 71*a* is mounted on the upper frame 60*c* of the opening frame 60 so as to be open downward. Then, on the upper end of the movable frame 30, the roller 30*e* rolls along the rail groove 71*a* of the slide frame 71 and both side faces of the movable frame 30 are guided by a pair of guide walls 71*b*, facing each other, of the slide frame 71. Additionally, on the lower end of the movable frame 30, the roller 30*e* rolls on the lower frame 60*d* of the opening frame 60.

Furthermore, one end of the extended cord 43*a* is fixed to the inner portion 30*a* of the movable frame 30 and led to the upper end portion of the movable frame 30, the cord 43*a* makes a turn at the upper end portion of the movable frame 30, the cord 43*a* is laid to the upper end portion of the fixed frame 20 along the upper end portion of the screen device 1F, the cord 43*a* makes a turn downward in the upper end portion of the fixed frame 20, the cord 43*a* is led to the lower end portion of the inner portion 20*b* of the fixed frame 20, the cord 43*a* turns back in the lower end portion of the fixed frame 20, and the other end of the cord 43*a* is fixed to the guide part 10 (free end of the lower screen guide 6) connected to the very end of the fixed frame 20 in the lower screen guide 6.

Additionally, one end of the extended cord 43*b* is fixed to the inner portion 30*a* of the movable frame 30 and led to the lower end portion of the movable frame 30, the cord 43*b* makes a turn in the lower end portion of the movable frame 30, the cord 43*b* is laid to the lower end portion of the fixed frame 20 along the lower end portion of the screen device 1F, the cord 43*b* makes a turn upward in the lower end portion of the fixed frame 20, the cord 43*b* is led to the upper end portion of the inner portion 20*b* of the fixed frame 20, the cord 43*b* turns back in the upper end portion of the fixed frame 20, and the other end of the cord 43*b* is fixed to the guide part 10 (free end of the upper screen guide 6) connected to the very end of the fixed frame 20 of the upper screen guide 6.

Figure 11A:
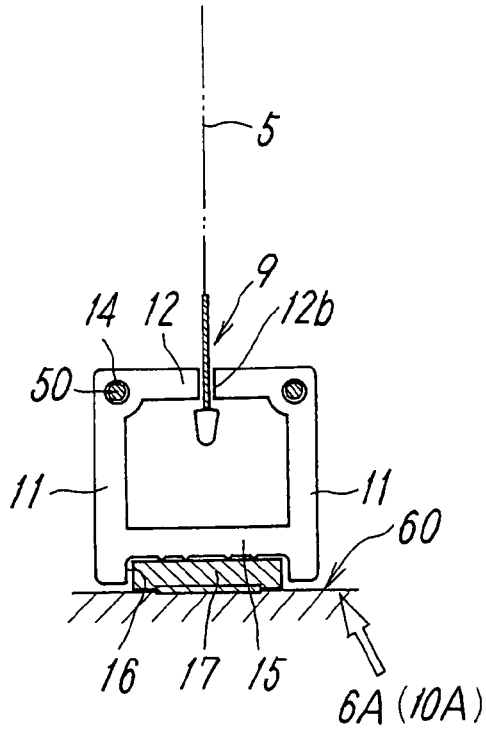
FIG. 11*a* is a partially enlarged sectional view showing a first modified example of the guide part and screen guide.
Figure 11B:
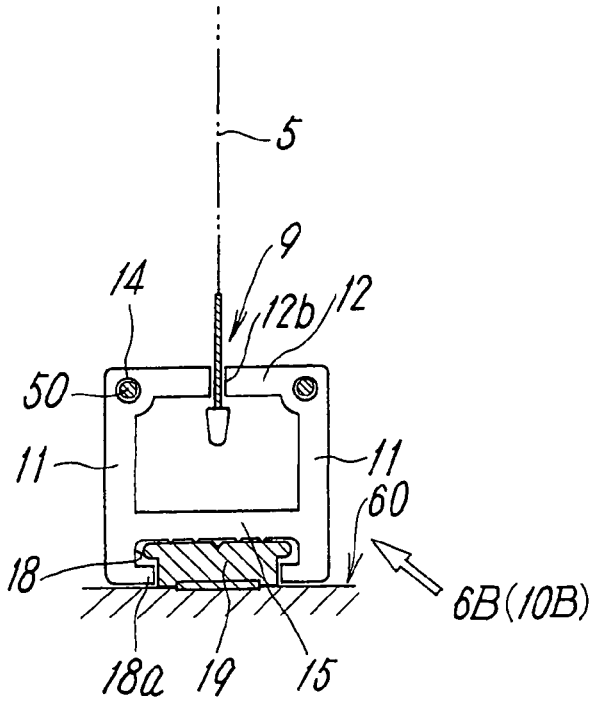
FIG. 11*b* is a partially enlarged sectional view showing a second modified example of the guide part and screen guide.

FIGS. 11*a* and 11*b* show modified examples of the screen guide 6 and the guide part 10. However, only the construction parts different from the screen guide 6 and the guide part 10 shown in FIG. 3*b*, FIG. 4*a*, and FIG. 4*b* are described and the other common construction parts are given the same reference numerals to avoid overlapping description.

In a guide part 10A of a screen guide 6A shown in FIG. 11*a*, a pair of side walls 11 and 11 is connected to each other by a connecting wall 15 in the middle portion thereof and a concave groove 16 is formed on the surface opposite to the inside surface 12*a*, that is, on the surface opposite to the screen 5 by the inner surfaces of the side walls 11 and 11 and the bottom surface of the connecting wall 15. Then, the screen guide 6B on the opening frame 60 is guided in such a way that the concave groove 16 sits astride a guide rail 17 provided in a protruding condition on the opening frame 60 so as to slide freely.

Additionally, in a guide part 10B of a screen guide 6B shown in FIG. 11*b*, a concave groove 18 is formed in the same way as in the guide part 10A and alligator mouth portions 18*a* toward the inside are provided at each opening edge of the concave groove 18. Then, the screen guide 6B on the opening frame 60 is guided by the guide rail 19 in such a way that the concave groove 18 sits astride a substantially T-shaped guide rail 19, to which the alligator mouth portion is joined, provided in a protrusion condition on the opening frame 60 so as to slide freely. However, the screen guide 6B and the guide part 10B can be applied to a winding-up screen device of the type in which the screen guide goes in and out of the inner portion of the fixed frame as in the second embodiment, fourth embodiment, and sixth embodiment.

Figure 12A:
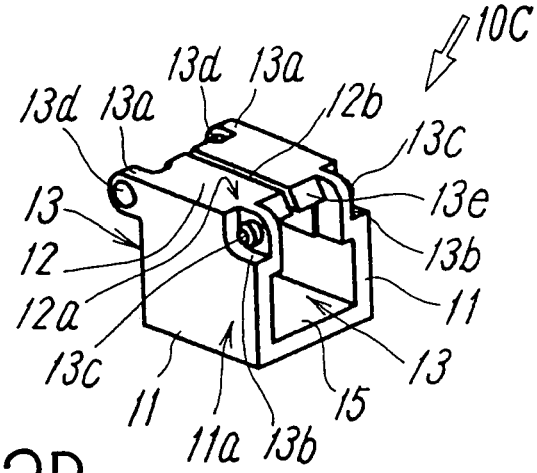
FIG. 12*a* is an enlarged perspective view showing another form of the guide part.
Figure 12B:
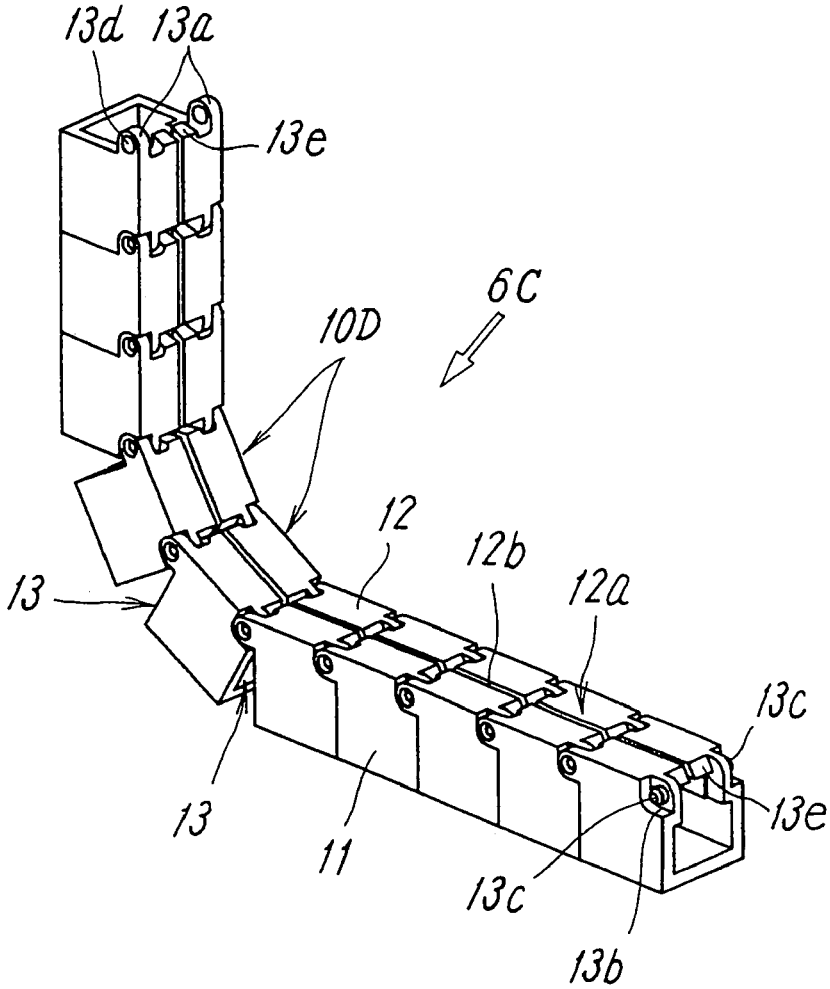
FIG. 12*b* is an enlarged perspective view showing a screen guide formed by connecting the guide part of FIG. 12*a*.

FIGS. 12*a* and 12*b* show a second form of screen guide and guide part. Moreover, here, the construction parts different from the screen guide 6 and guide part 10 shown in FIGS. 3*b*, 4*a* and 4*b* are described and the other common construction parts are given the same reference numerals to avoid overlapping description.

The guide part 10C shown in FIGS. 12*a* and 12*b* contains a pair of convex portions 13*a* provided in a protruding condition in a direction of axial line from one end face out of both end faces 13 and 13 in the axial direction on both sides sandwiching the joining groove 12*b* of the end portion on the side of the inner surface 12*a* and a pair of concave portions 13*b* formed so as to sit astride at least the other end face 13 and the inner surface 12*a* and housing the convex portions 13*a* of a neighboring guide part 10*c*, and rotational axes 13*c* and bearing holes 13*d* are formed to mate with the convex portions 13*a* and the convex portion 13*b* so as to rotate freely. Then, a plurality of guide parts 10*c* are linked to form a screen guide 6*c* in such as way that the convex portions 13*a* and concave portions 13*b* in neighboring guide parts 10*c* and 10*c* mate with the rotational axes 13*c* and bearing holes 13*d* and they are joined to each other.

Concretely, in the guide part 10C, the pair of convex portions 13*a* and 13*a* provided in a protruding condition from one end face 13 is formed so as to have a substantially circular-arc outer surface and has the bearing holes 13*d* provided in the direction perpendicular to the axial line of the guide part 10C. The pair of concave portions 13*b* and 13*b* is formed to sit astride the side face 11*a*, the inner surface 12*a*, and the other end face 13 and has the rotational axes 13*c* provided in a protrusion condition in the direction perpendicular to the axial line of the guide part 10, and the inner surface of the concave portions 13*b* is also formed so as to be substantially in a circular-arc shape.

Furthermore, also in this screen guide 6C, restriction of the range of circular move by the contact of the outer surface of the convex portion 13*a* against the inner surface of the concave portion 13*b* between guide parts neighboring to each other and convex bending of the screen guide 6C toward the side of the screen 5 (side of the inner surface 12*a*), that is, floating of the screen guide 6C from the opening frame 60 can be prevented as much as possible.

Moreover, tapered portions 13*e* and 13*e* are formed at both ends in the direction of axial line (in the axial direction) of the inner wall 12 and smooth bending of neighboring guide parts 10C toward the side of the inner surface 12*a*, that is, smooth concave bending toward the side of the inner surface 12*a* of the screen guide 6C are made possible.

The invention claimed is:

1. A winding-up screen device, comprising:

a fixed frame configured to be fixed to an opening frame of a building;

a movable frame provided so as to be parallel to the fixed frame and configured to be movable towards and away from the fixed frame;

a screen wound around a winding axis, the screen provided so as to extend between the fixed frame and the movable frame, and the screen configured to be opened and closed by winding and unwinding the screen around the winding axis with forward and backward movement of the movable frame; and a screen guide formed so as to be long and bendable, the screen being configured to be inserted into and withdrawn from an inner portion of the fixed frame or the movable frame through an opening provided in an end portion of the fixed frame or the movable frame with the forward and backward movement of the movable frame, and configured to be linearly positioned along an edge portion of the screen unwound from the winding axis and configured to guide the edge portion, wherein a joining part is attached to the screen along the edge portion to be guided by the screen guide, wherein the screen guide includes a plurality of guide parts in which a joining groove is provided in an axial direction on an inner surface disposed on a screen side and neighboring guide parts of the plurality of guide part are connected at both sides of the joining groove on the inner surface so as to be bendable, and wherein the joining part of the screen unwound from the winding axis is joined to the joining groove of the screen guide withdrawn from the fixed frame or the movable frame so as to slide freely.

2. A winding-up screen device as claimed in claim 1, wherein the joining part includes a plurality of protrusion portions fixed along one end of a part fixed to the edge portion of the screen.

3. A winding-up screen device as claimed in claim 1, wherein the guide part contains a pair of connection holes passing through in the axial direction on both sides of the joining groove on the inner surface, and the neighboring guide parts are connected to each other by flexible wire parts passing through the pair of connection holes.

4. A winding-up screen device as claimed in claim 1, wherein each of the plurality of guide parts contains a pair of convex portions including bearing holes and a pair of concave portions including rotation axes protruding therefrom, the pair of convex portions and the pair of concave portions are located on both sides of the joining groove on the inner surface, and the neighboring guide parts are connected to each other by positioning the rotational axes of the concave portions of one guide part within the bearing holes in the convex portions of another guide part.

5. A winding-up screen device as claimed in claim 1, wherein the neighboring guide parts are connected to each other without a space between the neighboring guide such that convex bending toward the inner surface of the screen guide is suppressed.

6. A winding-up screen device as claimed in claim 1, wherein one end of the screen guide is fixed to the fixed frame and the screen guide is inserted into and withdrawn from the inner portion of the movable frame with the forward and backward movement of the movable frame, one end of the screen is held in the inner portion of the movable frame, and the winding axis holds an other end of the screen and winds the screen, and the winding axis is supported in the inner portion of the fixed frame so as to be rotational.

7. A winding-up screen device as claimed in claim 1, wherein one end of the screen guide is fixed to the movable frame and the screen guide is inserted into and withdrawn from the inner portion of the fixed frame with the forward and backward movement of the movable frame, one end of the screen is held in the inner portion of the fixed frame and the winding axis holds an other end of the screen and winds the screen, and the winding axis is supported in the inner portion of the movable frame so as to be rotational.

8. A winding-up screen device as claimed in claim 1, wherein each of the plurality of guide parts contains a concave groove on a surface opposite to the inner surface, the opening frame includes a guide rail protruding therefrom, and when the screen guide withdrawn from the fixed frame or the movable frame onto the opening frame, the concave groove of the screen guide is guided by the guide rail.

9. A winding-up screen device as claimed in claim 1, wherein the screen is opened and closed by horizontal movement of the movable frame, and the screen guide is positioned along the lower edge portion of the screen when the screen is unwound from the winding axis.

10. A winding-up screen device as claimed in claim 9, wherein a slide part is positioned on an upper end of the movable frame, and the movable frame is suspended by the slide part from a slide frame fixed to an upper frame of the opening frame so as to freely slide along the slide frame.

11. A winding-up screen device as claimed in claim 1, wherein the screen guide is positioned along both edge portions of the screen unwound from the winding axis.

12. A winding-up screen device as claimed in claim 1, further comprising:

a wiring mechanism including extended cords, wherein the wiring mechanism provides tension to the extended cords to maintain the fixed frame in a position parallel to the movable frame.

13. A winding-up screen device as claimed in claim 1, wherein the screen is an insect prevention net.

14. A winding-up screen device as claimed in claim 2, wherein the guide part contains a pair of connection holes passing through in the axial direction on both sides of the joining groove on the inner surface, and the neighboring guide parts are connected to each other by flexible wire parts passing through the pair of connection holes.

15. A winding-up screen device as claimed in claim 2, wherein each of the plurality of guide parts contains a pair of convex portions including bearing holes and a pair of concave portions including rotation axes protruding therefrom, the pair of convex portions and the pair of concave portions are located on both sides of the joining groove on the inner surface, and the neighboring guide parts are connected to each other by positioning the rotational axes of the concave portions of one guide part within the bearing holes in the convex portions of another guide part.

* * * * *